US007378380B2

(12) United States Patent
Blagg et al.

(10) Patent No.: US 7,378,380 B2
(45) Date of Patent: May 27, 2008

(54) DILUTABLE CLEANING COMPOSITIONS AND THEIR USES

(75) Inventors: Adrian Blagg, Hessle (GB); Angus Lang, Hull (GB); Malcolm Tom McKechnie, Hull (GB)

(73) Assignee: Reckitt Benckiser (UK) Limited, Berkshire (GB)

( * ) Notice: Subject to any disclaimer, the term of this patent is extended or adjusted under 35 U.S.C. 154(b) by 0 days.

(21) Appl. No.: 11/873,212

(22) Filed: Oct. 16, 2007

(65) Prior Publication Data

US 2008/0045433 A1 Feb. 21, 2008

Related U.S. Application Data

(63) Continuation of application No. 10/501,667, filed as application No. PCT/GB03/00231 on Jan. 17, 2003, now abandoned.

(30) Foreign Application Priority Data

Jan. 18, 2002 (GB) ..... 0201133.6

(51) Int. Cl.
*C11D 3/00* (2006.01)
*C11D 3/10* (2006.01)
*C11D 17/00* (2006.01)

(52) U.S. Cl. ..... 510/108; 510/116; 510/191; 510/220; 510/238; 510/276; 510/375; 510/379; 134/42

(58) Field of Classification Search ..... 510/108, 510/116, 191, 220, 238, 276, 375, 379; 134/42
See application file for complete search history.

(56) References Cited

U.S. PATENT DOCUMENTS 2,992,186 A 7/1961 Hellsten
3,255,117 A 6/1966 Knapp et al.
3,632,516 A 1/1972 Antonelli et al.
3,708,429 A 1/1973 Hall
4,206,068 A 6/1980 Davis
4,412,934 A * 11/1983 Chung et al. ..... 252/186.38
4,417,993 A * 11/1983 Gergely ..... 510/117
4,522,738 A 6/1985 Magid et al.
4,599,116 A 7/1986 King et al.
4,801,636 A 1/1989 Smith et al.
4,908,215 A 3/1990 Perlman
5,132,107 A * 7/1992 Lange ..... 514/345
5,152,912 A * 10/1992 Dziabo et al. ..... 510/112
5,505,740 A * 4/1996 Kong et al. ..... 8/111
5,716,923 A 2/1998 MacBeath
5,747,438 A * 5/1998 MacBeath ..... 510/224
5,783,540 A * 7/1998 Secemski et al. ..... 510/224
5,900,395 A * 5/1999 Nicholson et al. ..... 510/224
5,972,870 A 10/1999 Anderson
6,262,013 B1 * 7/2001 Smith et al. ..... 510/529
6,448,212 B1 9/2002 Holderbaum et al.
6,468,950 B1 10/2002 Kawasaki et al.
6,514,429 B1 2/2003 Waschenbach et al.

FOREIGN PATENT DOCUMENTS

EP 0290081 A1 * 11/1988
EP 1038947 A3 9/2000
EP 1104805 A2 6/2001
EP 0564251 A3 10/2007
GB 2000177 1/1979
WO 97/31087 8/1997
WO 9731087 A1 8/1997
WO 98/58544 12/1998
WO 9857544 A1 12/1998
WO 9919432 4/1999
WO 0004117 1/2000
WO 0006682 A1 2/2000
WO 0196520 12/2001

OTHER PUBLICATIONS

Gyula Rabai et al, Chaotic pH Oscillations in the Hydrogen Peroxide—Thiosulfate-Sulfite Flow System, J. Physical Chemistry A 1999, 103, 7268-7273.

* cited by examiner

*Primary Examiner*—Lorna M. Douyon
(74) *Attorney, Agent, or Firm*—Norris McLaughlin & Marcus, PA

(57) ABSTRACT

A dilutable cleaning composition comprises a pH-elevating component and a pH-lowering component, the composition being such that when it is mixed with water the pH-elevating component dissolves or disperses in the water thereby elevating the pH of the water to at least 8.5 and subsequently the pH-lowering component dissolves or disperses in the water, thereby lowering the pH of the water from at least 8.5 to not more than 4. When the water is at the raised pH, the cleaning composition is effective in removing proteinaceous or fatty soiling, and when the composition is at the lowered pH, the composition is effective at removing alkaline waste materials such as limescale. The cleaning composition is particularly suitable for use as a lavatory or hard surface cleaner.

22 Claims, No Drawings

DILUTABLE CLEANING COMPOSITIONS AND THEIR USES

This application is a continuation of U.S. application Ser. No. 10/501,667, now abandoned, which is a 371 of PCT/GB03/100231 filed Jan. 17, 2003, which claims priority under 35 USC § 119 of United Kingdom Application No. 0201133.6 filed Jan. 18, 2002.

This invention relates to chemical compositions; in particular to cleaning compositions and their uses in methods of cleaning.

Bathroom cleaners are usually acidic compositions, intended to combat deposits of calcium salts. On the other hand kitchen cleaners are usually alkaline compositions, intended to combat proteinaceous and grease deposits. However there are situations in which for bathroom cleaning, an alkaline composition is required; and in which for kitchen cleaning, an acidic composition is required. The customer has to decide whether to purchase different products for different cleaning tasks, or whether to compromise.

It would be of benefit to have a single composition able to combat the deposits attacked by acidic cleaning compositions and the deposits attacked by alkaline cleaning compositions.

It would also be advantageous to have a cleaning composition which is initially alkaline, to effect a first stage of cleaning of a substrate, but which does not remain so, in order to prevent damage to the substrate, and to effect a second, acidic, stage of cleaning of the substrate.

According to a first aspect of the present invention, there is provided a dilutable cleaning composition comprising a pH-elevating component and a pH-lowering component, the composition being such that when it is mixed with water the pH-elevating component dissolves or disperses in the water and the pH of the water is elevated to at least 8.5 and subsequently the pH-lowering component dissolves or disperses in the water and the pH of the water is lowered from at least 8.5 to not more than 4.

The water with which the composition is mixed is typically mains water. Accordingly the composition should be such that the characteristics defined herein are exhibited with any mains water.

There may be more than one pH-elevating component, together acting to attain the elevated pH, and more than one pH-lowering component, together acting to attain the lowered pH.

The pH-elevating component may include any suitable compound which, on dissolution or dispersion in water, raises the pH, or assists in raising the pH, to at least 8.5.

Suitable pH-elevating compounds include inorganic compounds, preferably alkali metal compounds, especially alkali metal carbonates, bicarbonates and hydroxides, and alkali metal peroxy compounds, preferably percarbonates and perborates. Especially preferred are sodium carbonate, sodium bicarbonate, sodium hydroxide, sodium percarbonate and sodium perborate.

The pH-lowering component may include any suitable compound which, on dissolution or dispersion in water, lowers the pH, or assists in lowering the pH, to not more than 4.

Suitable pH-lowering compounds include organic and inorganic acids or precursor compounds thereto. Particularly suitable acids include organic acids, for example citric acid, formic acid, lactic acid, succinic acid and acetic acid, and inorganic acids, for example sulphamic acid. Sulphamic acid is especially preferred.

Typically an acid precursor may be an acid halide, acid anhydride or aldehyde.

Preferably the composition contains an oxidising agent and a reducing agent. Examples of suitable oxidising agents include sodium chlorite and sodium perborate. Examples of suitable reducing agents include potassium iodide, sodium sulphite and ferrous ammonium sulphate. Preferably the oxidising agent (or agents) and the reducing agent (or agents) are segregated from each other, in the composition. Preferably one is dissolved or dispersed together with the pH-elevating component(s) and the other is dissolved or dispersed together with the pH-lowering component(s).

Preferably the pH of the water is elevated to at least 9, more preferably to at least 9.5, by the pH-elevating component(s).

Preferably the pH of the water is lowered to not more than 3, more preferably not more than 2, by the pH-lowering component(s).

Suitably the pH change from the elevated pH to the lowered pH, on dissolution or dispersion of the pH-lowering component(s) in the water, is at least 6, preferably at least 7.

Preferably the pH of the water is elevated by pH-elevating component(s) to a value of at least 8.5 after a dwell time (that is, after an interval after exposure of the composition to the water). Preferably the dwell time does not exceed 600 seconds, more preferably does not exceed 400 seconds, most preferably does not exceed 300 seconds, and, especially, does not exceed 120 seconds. Preferably the dwell time is at least 30 seconds, more preferably at least 45 seconds and most preferably at least 60 seconds.

Suitably the composition is such that the pH of the water is lowered to not more than 4 by the pH-lowering component (s) within 600 seconds of the pH of the water reaching 8.5, preferably within 400 seconds, more preferably within 300 seconds.

The composition is preferably a solid, more preferably a powder or granules, or a block of consolidated powder or granules. When the composition is in the form of a block of consolidated powder or granules, the block may be such that it breaks apart or disperses when in contact with water.

Any solid form of the composition may desirably contain a desiccant.

Any block form of the product may desirably contain a disintegrant.

The composition may be provided as a dispersion or suspension of a solid composition, preferably powder or granules, in a suitable liquid carrier. Suitably such a composition may be provided as a colloidal suspension or emulsion in a suitable liquid carrier. Suitably the liquid carrier is an aqueous carrier.

Preferably the pH-elevating component(s) and pH-lowering component(s) are arranged to be added simultaneously to the water, the composition comprising means to substantially prevent dissolution or dispersion of the pH-lowering component until a predetermined interval has elapsed and/or the pH of the water has been elevated by the pH-elevating component(s).

Suitably the dissolution or dispersal of the pH-lowering component(s) occurs (preferably commences) subsequent to the completion of the dissolution or dispersion of the pH-elevating component(s).

Suitably a dissolution retarder is associated with the pH-lowering component(s). Thus, the latter may be coated with or enclosed by or admixed with a material which dissolves or disperses in water at a rate slower than the rate of dissolution or dispersion of the pH-elevating component (s), in the water. In some embodiments it may be desirable for the pH-elevating component(s) to be associated with a dissolution or dispersion retarder, albeit of lesser effect than the dissolution or dispersion retarder of the pH-lowering component(s). By such means the initial elevation of pH may be attained thereby providing the dwell time mentioned above.

The pH-elevating and pH-lowering components may be kept physically separated from each other, for example in a dissolvable tablet or dissolvable sachet having two or more zones, which may be layers or encapsulated sections. Such zones may dissolve at different rates.

The composition may advantageously be provided as a powder or granules, free flowing or pressed into a block, and comprising a first component or stage comprising the pH-elevating component(s), and a second component or stage, comprising the pH-lowering component(s) associated with a dissolution or dispersion retarder.

Thus the second component may comprise powder particles or granules coated with or enclosed by or admixed with a dissolution or dispersion retarder.

Alternatively, the composition may be provided as a powder or granules, flowable or pressed into a block, in which the second component as a body is coated with a layer or skin of a dissolution or dispersion retarder.

Alternatively the composition is provided as a block wherein the second component as a body is coated with the first component, which acts as the dissolution or dispersion retarder; or wherein there is a dissolution or dispersion retarder between the second, inner, and first, outer, components.

The dissolution or dispersion retarder may be a material which is dissolved or dispersed or otherwise rendered ineffective after a certain length of time in water. However, in some embodiments its retardation effect is dependent upon, for example prolonged, or shortened or otherwise diminished, by change of pH.

In particular the dissolution or dispersion retarder may be a material whose effectiveness in retarding dissolution or dispersion diminishes at the higher pHs reached in the present invention. At such pHs, in particular above pH 8.5, it may quickly dissolve, or disperse, or otherwise become ineffective in retarding the dissolution or dispersion of the pH-lowering component(s); whereas at neutral or near-neutral pH it is effective for that purpose.

Alternatively or additionally the timing of basicifying then acidifying the water may be a function, wholly or in part, of granulometry. To this end coarser pH-lowering component(s) and finer pH-elevating component(s) may be employed.

Differences in compaction of portions of a tablet derived from a powder or granules may also be employed; a portion containing the pH-lowering component(s) being compacted more than a portion containing the pH-elevating component (s).

The pH-elevating component(s) may be provided in liquid form, with the pH-lowering component(s) being provided as a suspension or dispersion of powder or granules therein.

The composition may include an indicator which changes colour in response to a change in pH in the water containing the cleaning composition. One or more of the components responsible for a change of pH may cause a change of colour, for example on exhaustion, or a separate dye or colorant may be included in the composition, responsive to pH change or to the presence or absence of oxidant species, or of reductant species.

Other means of indicating pH change other than by a colour change may be employed. For example the composition could be arranged to effervesce when dissolution or dispersion of the pH-elevating and/or pH-lowering component(s) takes place, for example by including a bicarbonate, suitably in the pH-lowering component(s).

Clearly components of the composition should be selected having regard to compatibility with other components which may, as noted above, include reducing agents and oxidising agents.

The term "cleaning" as used herein may include: removal of soil deposits; de-scaling; prevention of soiling; bleaching; and combating of microbes, including by one or more of antiseptic, disinfectant and bactericidal action.

Preferably, the composition is antimicrobial. Preferably an antimicrobial effect is generated by dissolution or dispersal of either or both of the pH-modifying components. Preferably an antimicrobial chemical is generated in situ or released by dissolution or dispersion. It is preferably released by the change in pH to acidic, and therefore with the same delay. The antimicrobial chemical may, for example, comprise an iodate, bromate, thiocyanate, chlorate or peroxy compound, or chlorine dioxide (generated from a chlorite), chlorine, bromine or iodine.

The composition preferably produces a bleaching effect. Preferably a bleaching effect is generated on dissolution or dispersal of either or both of the pH-modifying components, but preferably by the change in pH to acidic, and/or by production of a bleaching chemical, suitably due to the change in pH. As well as a bleaching agent being produced or released by a change in pH, it may be produced or released spontaneously on contact with water.

In a preferred embodiment the composition includes sodium chlorite generating, under acid conditions, chlorine dioxide.

In another preferred embodiment the composition contains hydrogen peroxide or a precursor to it, as a bleaching agent. A preferred precursor is an alkalinity-promoting alkali metal "per" salt, for example sodium perborate.

The composition may include one or more surfactants, which are desirably resistant to oxidising and reducing agents. A surfactant used in the present invention may be selected from one or more surfactants which may be anionic, cationic, nonionic or amphoteric (zwitterionic) surface active agents.

One class of nonionic surfactants which may be used in the present invention are alkoxylated alcohols, particularly alkoxylated fatty alcohols. These include ethoxylated and propoxylated fatty alcohols, as well as ethoxylated and propoxylated alkyl phenols, both having alkyl groups of from 7 to 16, more preferably 8 to 13 carbon chains in length.

Examples of alkoxylated alcohols include certain ethoxylated alcohol compositions presently commercially available from the Shell Oil Company (Houston, Tex.) under the general trade name NEODOL (trade mark), which are described to be linear alcohol ethoxylates and certain compositions presently commercially available from the Union Carbide Company, (Danbury, Conn.) under the general trade name TERGITOL (trade mark) which are described to be secondary alcohol ethoxylates.

Examples of alkoxylated alkyl phenols include certain compositions presently commercially available from the Rhône-Poulenc Company (Cranbury, N.J.) under the general trade name IGEPAL (trade mark), which are described as octyl and nonyl phenols.

Examples of anionic surface active agents which may be used in the present invention include but are not limited to: alkali metal salts, ammonium salts, amine salts, aminoalcohol salts or the magnesium salts of one or more of the following compounds: alkyl sulphates, alkyl ether sulphates, alkylamidoether sulphates, alkylaryl polyether sulphates, monoglyceride sulphates, alkylsulphonates, alkylamide sulphonates, alkylarylsulphonates, olefinsulphonates, paraffin sulphonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl saronsinates, acyl isothionates and N-acyl taurates. Generally, the alkyl or acyl group in these various compounds comprises a carbon chain containing 12 to 20 carbon atoms.

Other anionic surface active agents which may be used include fatty acid salts, including salts of oleic, ricinoleic, palmitic and stearic acids; copra oils or hydrogenated copra oil acid, and acyl lactylates whose acyl group contains 8 to 20 carbon atoms.

Examples of cationic surfactants which may be used in the present invention include quaternary ammonium compounds and salts thereof, including quaternary ammonium compounds which also have germicidal activity and which may be characterized by the general structural formula:

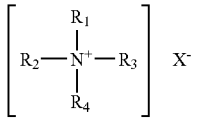

when at least one of $R_1$, $R_2$, $R_3$ and $R_4$ is a hydrophobic, aliphatic, aryl aliphatic or aliphatic aryl group containing from 6 to 26 carbon atoms, and the entire cationic portion of the molecule has a molecular weight of at least 165. The hydrophobic groups may be long-chain alkyl, long-chain alkoxy aryl, long-chain alkyl aryl, halogen-substituted long-chain alkyl aryl, long-chain alkyl phenoxy alkyl or aryl alkyl. The remaining groups on the nitrogen atoms, other than the hydrophobic radicals, are generally hydrocarbon groups usually containing a total of no more than 12 carbon atoms. $R_1$, $R_2$, $R_3$ and $R_4$ may be straight chain or may be branched, but are preferably straight chain, and may include one or more amide or ester linkages. X may be any salt-forming anionic moiety.

Examples of quaternary ammonium salts within the above description include the alkyl ammonium halides such as cetyl trimethyl ammonium bromide, alkyl aryl ammonium halides such as octadecyl dimethyl benzyl ammonium bromide, and N-alkyl pyridinium halides such as N-cetyl pyridinium bromide. Other suitable types of quaternary ammonium salts include those in which the molecule contains either amide or ester linkages, such as octyl phenoxy ethoxy ethyl dimethyl benzyl ammonium chloride and N-(lauryl-cocoaminoformylmethyl)-pyridinium chloride. Other effective types of quaternary ammonium compounds which are useful as germicides includes those in which the hydrophobic moiety is characterized by a substituted aromatic nucleus as in the case of lauryloxyphenyltrimethyl ammonium chloride, cetylaminophenyltrimethyl ammonium methosulphate, dodecylphenyltrimethyl ammonium methosulphate, dodecylphenyltrimethyl ammonium chloride and chlorinated dodecylphenyltrimethyl ammonium chloride.

Preferred quaternary ammonium compounds which act as germicides and which are useful in the present invention include those which have the structural formula:

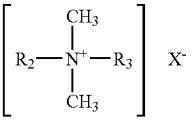

wherein $R_2$ and $R_3$ are the same or different $C_8$-$C_{12}$alkyl, or $R_2$ is $C_{12}$-$C_{16}$alkyl, $C_8$-$C_{18}$alkylethoxy, $C_8$-$C_{18}$alkyl-phenolethoxy and $R_3$ is benzyl, and X is a halide, for example chloride, bromide or iodide, or methosulphate. Alkyl groups $R_2$ and $R_3$ may be straight chain or branched, but are preferably substantially linear.

A mixture of two or more surface active agents may also be used. Other known surface active agents not particularly described above may also be used. Such surface active agents are described in McCutcheon's Detergents and Emulsifiers, North American Edition, 1982; Kirk-Othmer, Encyclopaedia of Chemical Technology, 3rd Ed., Vol. 22, pp 346-387.

The compositions of the present invention may include therein one or more organic solvents, such as lower alkyl alcohols, lower alkyl diols or glycol ethers. Such compounds may function as a cleaning agent of the compositions, and may be especially useful in glass cleaners due to their lack of tendency to smear.

In addition to the change of pH caused consequent upon differential dissolution or dispersion rates, a contribution to the pH change may come from a chemical reaction.

Thus, cleaning compositions employing chemical compounds promoting alkaline to acid pH changes by chemical reaction may be envisaged, as being additional to components bringing about the dissolution- or dispersion-mediated changes of pH mentioned above.

Thus, preferably the composition may contain compounds which promote an alkaline to acid pH change by chemical reaction. The autocatalytic species for the reaction is $H^+$ and pH steps may occur when a solution of a weak acid is oxidised to provide a strong acid, so that $H^+$ concentration increases with the extent of reaction.

A composition including a typical chemical reaction-mediated pH step system will involve an oxidant and a reductant. Typically, the reductant will be the salt of a weak acid and the corresponding oxidant will be a strong acid. Of course, a reaction may employ a plurality of oxidants and/or a plurality of reductants.

Many different species can be used as partners in these redox systems giving pH steps via chemical reactions. In seeking appropriate species, a useful guide for the overall reaction stoichiometry is that the reducing agent should release more protons per electron than the oxidising agent consumes.

Within the existing literature, the following species can be identified and may be of use in cleaning compositions of the invention:

Potential Oxidant:

I peroxo-compounds (eg $BrO_3^-$, $IO_3^-$, $ClO_3^-$, $ClO_2^-$, $S_2O_8^{2-}$, $ClO_2$, $H_2O_2$ or a precursor thereof)

II oxidising metal compounds stable in alkaline solutions (eg $[Fe(CN)_6]^{3-}$).

Potential Reductant:

I all oxyanions of sulphur that contain S—S bonds (eg $S_2O_3^{2-}$, $S_4O_6^{2-}$, $S_2O_4^{2-}$, $S_2O_6^{2-}$).

II reducing agents that are significantly more basic than their oxidised counterparts (eg $SO_3^{2-}$, $HSO_3^-$, $AsO_3^{3-}$, $S_2O_3^{2-}$, $S_4O_6^{2-}$, $N_2H_5^+$, $[Fe(CN)_6]^{4-}$).

There are also reports of pH step reactions involving permanganate ions as oxidant with the reductant being sulphite, nitrite, selenite, arsenite, thiosulfate+iodide+$H_2O_2$ or a precursor thereof.

Examples of precursors of hydrogen peroxide include urea hydrogen peroxide (UHP) and a cyclodextrin complexed with an organic peroxy acid, for example as described in EP-A-895777. An example is β-cyclodextrin complexed with an organic peroxy acid, e-phthalimido peroxyhexanoic acid (PAP). This product is available under the trade mark EURECO HC from Wacker Chemie GmbH.

In general a preferred cleaning composition of the present invention is a hard surface cleaner (HSC), for cleaning ceramics, glass, stone, plastics and wood; and particularly for cleaning bathroom and kitchen hard surfaces, for example sinks, bowls, toilets, panels, tiles and worktops. When acidic it is particularly effective in combating limescale. When alkaline it is particularly effective in combating grease and proteinaceous deposits.

A preferred cleaning composition is adapted for cleaning lavatory bowls and for this purpose the composition may be packaged in an ITB (In Toilet Bowl) or ITC (In Toilet Cistern) device, preferably in a holder which hangs from the rim of the bowl or cistern. In the case of chemical reactants which are desirably kept apart until cleaning takes place the reactants are preferably solids formulated in separate compressed powders or granules, or gel blocks or in one tablet with distinct zones for the different pH modifying components.

Another preferred cleaning composition is adapted for cleaning dentures (normally of polyacrylic material) and is therefore effective in removing staining and/or plaque.

Cleaning compositions of the invention may be used as dishwasher cleaning compositions and may also be used in washing some textile materials. The change of pH may, for example, initiate the dissolution of the coating of a washing tablet or of an insert product contained within a washing tablet, providing delayed release of the contents.

The invention will now be further described, by way of example, with reference to the following examples.

EXAMPLE 1

A two stage ITB (In Toilet Bowl) lavatory cleaning composition was prepared as follows:

| Stage 1 | | |
|---|---|---|
| FD & C Blue Dye No. 1 | Colorant | 0.01 g |
| Sodium carbonate | Raises pH | 0.50 g |
| Sodium chlorite | Oxidising agent | 1.00 g |
| LATHANOL LAL | Ionic detergent | 0.50 g |
| Fragrance | | 0.20 g |
| Binder and disintegrant | | 0.50 g |
| | | 2.71 g |

The Stage 1 reagents were mixed together in a standard tumble mixer, to yield a powder.

| Stage 2 | | |
|---|---|---|
| Sodium bicarbonate (coarse) | Effervescent agent | 6.75 g |
| Sulphamic acid (fine) | Acid | 20.00 g |
| Sodium sulphite | Reducing agent | 1.50 g |
| LUTENSOL AT80 | Nonionic surfactant | 0.50 g |
| Sodium sulphate (anhydrous) | Desiccant | 0.90 g |
| Binder | | 0.50 g |
| | | 30.15 g |

The Stage 2 reagents were mixed together in a standard tumble mixer to yield a powder.

Total weight of the tablet was 32.9 g.

LATHANOL LAL (Trade Mark) is believed to be a sodium lauryl sulfoacetate.

LUTENSOL AT80 (Trade Mark) is believed to be a $C_{16-18}$ fatty alcohol having an average 80 EO units per molecule.

The Stage 1 powder was added to 400 ml of tap water (from the normal supply in Hull, UK) having a pH of 7.4, with gentle stirring, and the pH of the water was monitored. The pH of the solution rose to 9.6 within 60 seconds, and the water was left standing for a further 240 seconds and no further pH change was observed.

The Stage 2 powder was then added to the solution with gentle stirring and the pH monitored. The Stage 2 powder effervesced on dissolution, the pH dropped rapidly from approximately 9.5 to approximately 4 and a colour change was observed in the solution, from mid-blue to pale yellow after approximately 20 seconds from addition of Stage 2, and then to colourless within a further 20 seconds. The final pH was approximately 1.5.

The pH swing from the end of Stage 1 addition to the end of Stage 2 addition was approximately 8.

Prior to dissolution of stage 2 the oxidising agent was inactive and the solution was mildly alkaline making it safer for the consumer to scrub.

The results show that the addition of the Stage 1 and Stage 2 powders in sequence gave an effective dual stage, pH swing cleaning composition. In practice the Stage 1 and Stage 2 powders will be formulated such that they can be added simultaneously to water within a lavatory bowl or cistern, with the Stage 2 powder being coated or encapsulated with a dissolution-inhibiting agent or with a coating on the Stage 1 compacted powder, to prevent the Stage 2 composition from dissolving until the Stage 1 composition has dissolved.

EXAMPLE 2

A two stage ITB tablet comprises the following ingredients:

| Stage 1 | | |
|---|---|---|
| FD & C Blue Dye No. 1 | Colorant | 0.01 g |
| Sodium perborate•$H_2O$ | Oxidising agent | 3.05 g |
| Potassium iodide | Reducing agent | 1.00 g |
| LUTENSOL AT80 | Non-ionic detergent | 0.50 g |
| LATHANOL LAL | Ionic detergent | 0.50 |
| Fragrance | | 0.20 g |
| Binder and disintegrant | | 0.50 g |
| | | 5.26 g |

The Stage 1 reagents were mixed together in a standard tumble mixer to yield a powder.

| Stage 2 | | |
|---|---|---|
| Sodium bicarbonate (coarse) | Effervescent agent | 6.75 g |
| Sulphamic acid (fine) | Acid | 20.00 g |
| Sodium sulphate (anhydrous) | Desiccant | 0.90 g |
| Binder | | 0.50 g |
| | | 28.15 g |

The Stage 2 ingredients were mixed together in a standard tumble mixer to yield a powder. The powders were pressed to form a two-layer tablet in a standard rotary tablet press.

Total tablet weight of the tablet was 33.4 g

The tablet was added to 400 ml of Hull tap water.

Stage 1 consists of a rapidly dispersing/dissolving mixture of the dye, oxidising and reducing agents, surfactants and fragrance.

Stage 2 comprises an acid-effervescent system which begins to dissolve in 5-10 mins. The pH of the water then falls rapidly. A colour change from mid-blue to cyan then to apple green occurs over 5 mins. This is accompanied by effervescence and foaming. The final pH is approximately 1.8. The green colour darkens slightly with time. A total pH swing of 8 is obtained.

In this system the bleaching agent is active from the start. The iodide is oxidised to iodine which has antiseptic properties. The system is odourless.

EXAMPLE 3

A two-stage tablet for ITB use comprises the following ingredients:

| Stage 1 | | |
|---|---|---|
| FD & C Blue Dye No. 1 | Colorant | 0.01 g |
| Sodium carbonate (fine) | Raises pH | 0.50 g |
| Sodium chlorite | Oxidising agent | 1.00 g |
| LATHANOL LAL | Ionic detergent | 0.50 g |
| Binder and disintegrant | | 0.50 g |
| | | 2.51 g |

The Stage 1 reagents were mixed together in a standard tumble mixer to yield a powder.

| Stage 2 | | |
|---|---|---|
| Sodium bicarbonate (coarse) | Effervescent agent | 6.75 g |
| Sulphamic acid (fine) | Acid | 20.00 g |
| Ferrous ammonium sulphate | Reducing agent | 0.50 g |
| LUTENSOL AT80 | Nonionic surfactant | 0.50 g |
| Sodium sulphate (anhydrous) | Desiccant | 0.90 g |
| Binder/retardant | | 0.50 g |
| | | 29.15 g |

The Stage 2 ingredients were mixed together in a standard tumble mixer to yield a powder.

The powders were pressed to form a two-layer tablet in a standard rotary tablet press.

Total weight of the tablet was 31.7 g.

Stage 1 consists of a rapidly dispersing/dissolving mixture of the dye, oxidising agent, ionic surfactant and fragrance. The stage 1 mixture makes the toilet bowl water alkaline (pH 9.5).

Stage 2 is an acid-effervescent mixture also containing a reducing agent and non-ionic surfactant. It begins to dissolve in 5-10 mins. The pH of the water then falls rapidly. A colour change from mid-blue to apple green then occurs over about 5 mins. This is accompanied by effervescence and foaming. The final pH is 1.5.

A total pH swing of 8 is obtained.

In this system, prior to dissolution of Stage 2 the oxidising agent is inactive and the solution is mildly alkaline, making it safer for the consumer to effect a manual stage of cleaning, if wishes. Chlorine dioxide is produced. Chlorine dioxide is a stronger oxidising agent then sodium perborate monohydrate—it has 1.9 times the oxidising ability and is more active under acid conditions. Sodium chlorite does not produce chlorine. A mild chlorine-like odour is produced.

EXAMPLE 4

A two stage ITB (In Toilet Bowl) lavatory cleaning composition was prepared as follows:

Stage 1 and Stage 2 formulations were prepared as described in Example 1.

The Stage 2 powder was then compacted to form a tablet of consolidated powder. The tablet was then dipped into molten polyethylene glycol 4000 (PEG 4000) until completely immersed then removed and allowed to cool at ambient temperature until the PEG 4000 solidified, to form a water-soluble coating around the Stage 2 phase.

The Stage 1 powder and Stage 2 tablet were added simultaneously to 400 ml Hull tap water with gentle stirring, and the pH was monitored. The Stage 1 powder was seen to dissolve within 60 seconds, during which time the pH of the water rose to 9.6. The Stage 2 tablet began to very slowly effervesce almost immediately on addition to the water, and once the Stage 1 powder had fully dissolved, and the pH had risen to 9.6, the pH began to drop, reaching a minimum of 1.5 after 20 minutes.

The invention claimed is:

1. A dilutable cleaning composition comprising a pH-elevating component and a pH-lowering component, the pH-elevating component dissolves or disperses in water to form a mixture and the pH of the mixture is elevated to at least 8.5 and subsequently the pH-lowering component dissolves or disperses in the mixture and the pH of the mixture is lowered from at least 8.5 to not more than 4, wherein the composition is provided as a dispersion or suspension of a particulate component in a liquid carrier, and wherein the composition comprises a surfactant, an oxidizing agent and a reducing agent.

2. A dilutable cleaning composition according to claim 1, wherein the pH-elevating component comprises an alkali metal compound.

3. A dilutable cleaning composition according to claim 2, wherein the alkali metal compound comprises an alkali metal carbonate, bicarbonate, hydroxide or peroxy compound.

4. A dilutable cleaning composition according to claim 1, wherein the pH-lowering component comprises an organic acid or inorganic acid, or a precursor thereto.

5. A dilutable cleaning composition according to claim 1, wherein the pH-lowering component comprises sulphamic acid.

6. A dilutable cleaning composition according to claim 1, wherein the composition is such that when it is mixed with water the pH of the water is elevated to at least 9.

7. A dilutable cleaning composition according to claim 1, wherein the composition is such that in use the pH of the water is lowered to not more than 3, from the elevated pH.

8. A dilutable cleaning composition according to claim 1, wherein the composition is such that in use the pH change is at least 6.

9. A dilutable cleaning composition according to claim 1, wherein the composition is such that in use the pH of the water attains a value of at least 8.5 after a dwell time of at least 30 seconds, after addition to water of the pH-elevating component.

10. A dilutable cleaning composition according to claim 1, wherein the composition is such that in use the pH of the water attains a value of at least 8.5 after a dwell time of not more than 600 seconds, after addition to water of the pH-elevating component.

11. A dilutable cleaning composition according to claim 1, wherein the composition is such that in use the pH of the water is lowered to not more than 4 within 600 seconds of the water reaching a pH of at least 8.5.

12. A dilutable cleaning composition according to claim 1, wherein the pH-lowering component is coated with or enclosed by a dissolution or dispersal retarder which dissolves or disperses in water at a rate slower than the rate of dissolution or dispersal of the pH-elevating component in the water, thereby inhibiting dissolution or dispersal of the pH-lowering component relative to the pH-elevating component.

13. A dilutable cleaning composition according to claim 1, wherein the liquid carrier is an aqueous carrier.

14. A dilutable cleaning composition according to claim 1, wherein the pH-elevating component is provided in liquid form, with the pH-lowering component being provided as suspension or dispersion of powder or granules therein.

15. A dilutable cleaning composition according to claim 1, wherein the composition includes an indicator which changes colour on change of pH in the water.

16. A dilutable cleaning composition according to claim 1, wherein the composition is an antimicrobial composition.

17. A dilutable cleaning composition according to claim 1, wherein an antimicrobial effect is generated by dissolution or dispersal of either or both of the pH modifying components in the mixture.

18. A dilutable cleaning composition according to claim 16, wherein the antimicrobial composition comprises an iodate, bromate, thiocyanate, chlorate, or a halogen gas, chlorine dioxide or a peroxy compound.

19. A dilutable cleaning composition according to claim 1, wherein the composition produces a bleaching effect.

20. A dilutable cleaning composition according to claim 19 wherein the composition includes sodium chlorite generating chlorine dioxide under acid conditions; or a peroxy compound.

21. A dilutable cleaning composition according to claim 1, wherein the composition includes one or more surfactants.

22. A method of cleaning, which comprises the step of applying a quantity of a dilutable cleaning composition according to claim 1 to a surface in need of a cleaning treatment.

* * * * *